US009883728B2

(12) United States Patent
Denece

(10) Patent No.: US 9,883,728 B2
(45) Date of Patent: Feb. 6, 2018

(54) CASE FOR A STICK OF MATERIAL, SUCH AS A STICK OF LIPSTICK, INCLUDING A FLEXIBLE LIP, AND COSMETIC PRODUCT INCLUDING SUCH A STICK OF MATERIAL CONTAINED IN SUCH A CASE

(71) Applicant: AXILONE PLASTIQUE, Auray (FR)

(72) Inventor: Jean-Paul Denece, Baden (FR)

(73) Assignee: AXILONE PLASTIQUE, Auray (FR)

( * ) Notice: Subject to any disclaimer, the term of this patent is extended or adjusted under 35 U.S.C. 154(b) by 0 days.

(21) Appl. No.: 15/300,142

(22) PCT Filed: Mar. 27, 2015

(86) PCT No.: PCT/EP2015/056683

§ 371 (c)(1),
(2) Date: Sep. 28, 2016

(87) PCT Pub. No.: WO2015/144868

PCT Pub. Date: Oct. 1, 2015

(65) Prior Publication Data

US 2017/0143097 A1 May 25, 2017

(30) Foreign Application Priority Data

Mar. 28, 2014 (FR) ..... 14 52700

(51) Int. Cl.
*A45D 40/06* (2006.01)
*A45D 40/12* (2006.01)

(52) U.S. Cl.
CPC ..... *A45D 40/06* (2013.01); *A45D 40/12* (2013.01)

(58) Field of Classification Search
CPC ..... A45D 40/06; A45D 40/12
See application file for complete search history.

(56) References Cited

U.S. PATENT DOCUMENTS 5,234,275 A 8/1993 Gueret
6,109,808 A 8/2000 Susini et al.
(Continued)

FOREIGN PATENT DOCUMENTS

EP 0 491 579 A1 6/1992
EP 0 658 325 A1 6/1995
(Continued)

OTHER PUBLICATIONS

International Search Report, dated Jul. 10, 2015, from corresponding PCT Application.

*Primary Examiner* — Jennifer C Chiang
*Assistant Examiner* — Bradley Oliver
(74) *Attorney, Agent, or Firm* — Young & Thompson

(57) ABSTRACT

A case (1) for a stick of material to be applied by friction, in particular a stick of lipstick, including: a hollow cylindrical inner body (2), having a main axis (X), open at a proximal end (5), capable of receiving the stick of material; a hollow cylindrical outer body (7), having a main axis (X), open at a proximal end (10), into which the inner body (2) is inserted such as to pivot relative to the outer body (7) about the main axis (X), an outer cylindrical surface (4) of the inner body (2) facing a cylindrical inner surface (8) of the outer body (7); the case also including one flexible lip (34) for controlling the rotation torque about the main axis (X) of the inner body (2) inside the outer body (7).

19 Claims, 6 Drawing Sheets

(56) References Cited

U.S. PATENT DOCUMENTS

| | | | | |
|---|---|---|---|---|
| 6,139,208 | A * | 10/2000 | Monin-Bareil | A45D 40/06 401/55 |
| 6,312,179 | B1 * | 11/2001 | Gueret | A45D 40/06 401/78 |

FOREIGN PATENT DOCUMENTS

| | | | |
|---|---|---|---|
| EP | 0 943 262 | A2 | 9/1999 |
| GB | 2 430 429 | A | 3/2007 |
| WO | 97/05801 | A1 | 2/1997 |

* cited by examiner

FIG. 4
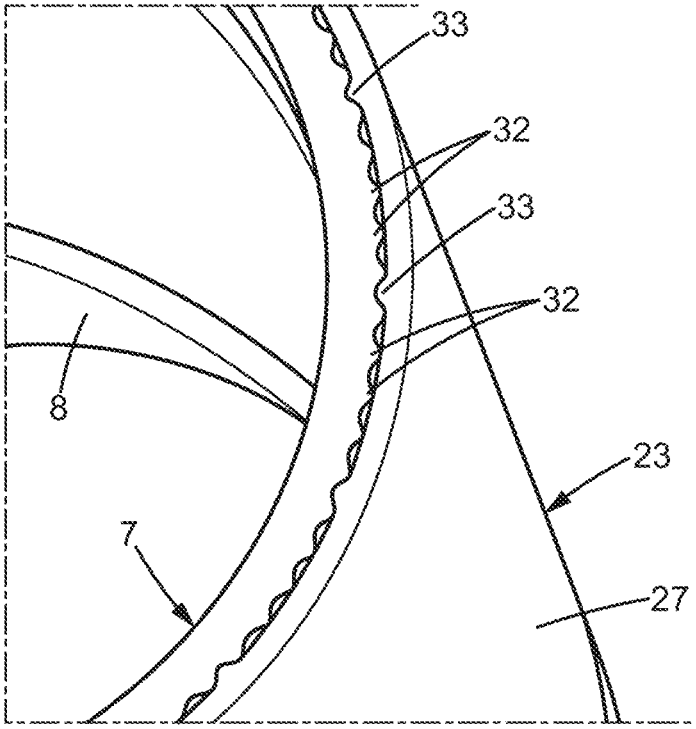
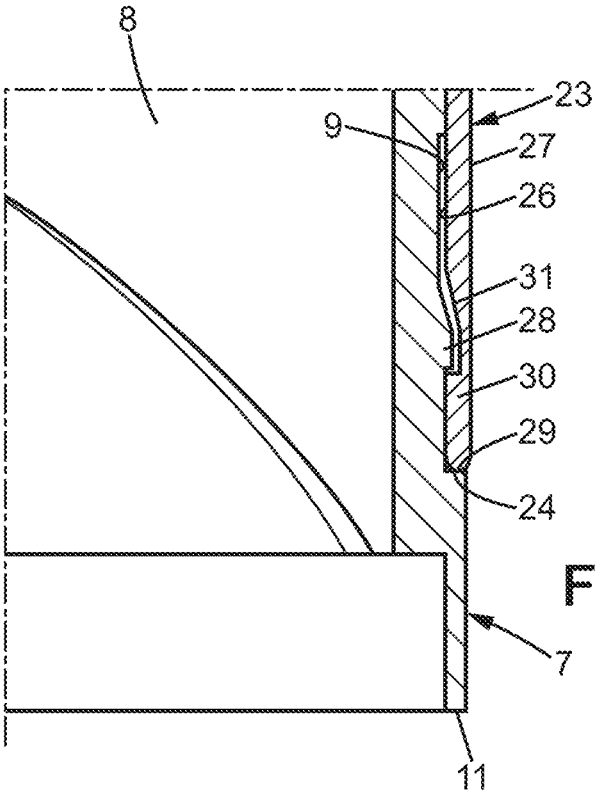
FIG. 5

CASE FOR A STICK OF MATERIAL, SUCH AS A STICK OF LIPSTICK, INCLUDING A FLEXIBLE LIP, AND COSMETIC PRODUCT INCLUDING SUCH A STICK OF MATERIAL CONTAINED IN SUCH A CASE

The invention relates to the field of cases for cosmetic products in stick form, such as tubes of lipstick.

More specifically, the invention relates to the field of cases comprising a mechanism to cause the stick of product to protrude, involving rotation of one part of the case relative to the other parts.

BACKGROUND OF THE INVENTION

Typically, a case for a tube of lipstick may comprise a cup into which a lower portion of the stick is inserted. The case comprises an inner body fitted into an outer body, and control elements for rotating the inner body relative to the outer body about a main axis. The cup is guided in translation along the main axis relative to the outer and inner body by means of a helical-type connection for example. More specifically, the inner body comprises for example vertical grooves, typically two, extending along the main axis, and the outer body comprises helical grooves, again typically two, the cup comprising tabs designed to engage with both the vertical grooves and the helical grooves. Thus, a rotation between the inner body and the outer body causes translational movement of the cup. An external sleeve, fixed to the outer body, may be added in order to provide, for example, a tidy finish or decorative elements.

A problem frequently encountered in lipstick cases concerns the minimum torque that must be applied to the inner body to rotate it relative to the outer body. If the torque is too low, the inner body could rotate within the outer body without any action by the user, simply due to gravity or impacts during transport. The stick of product would then protrude from the case unexpectedly and could be damaged. On the other hand, if the torque is too high, the user has to apply significant force to the inner body to cause it to rotate, which can be perceived as an annoyance by the user.

It is therefore necessary to provide a torque to be applied to the inner body for its rotation that ensures easy manipulation by the user, while limiting undesired rotation.

Several solutions for this have been investigated. For example, a substantially tight fit can be implemented between at least a portion of the inner body and of the outer body, with a lubricant enabling rotation between the inner body and the outer body. However, in addition to increasing costs, the use of a lubricant can result in odors unpleasant to the user. Leakage may also occur, both externally which is distasteful to the user and internally where it contaminates the product.

This is why a flexible lip has been developed, provided for example by the inner body and bearing against the outer body, exerting pressure against it. A gap is formed between the inner body and the outer body, and the lip ensures physical contact between the inner body and outer body. The lip allows applying minimal frictional torque to obtain rotation, while bridging the gap between the inner body and the outer body.

An example of such a lip is given in EP 0 491 579. The lip is presented therein in the form of an annular ring of triangular cross-section, formed on the inner body. The ring fits into a similarly annular groove formed in the outer body, and presses against the bottom of this groove.

Patent EP 0 943 262 gives a similar example of such a lip, in the form of a circular contact rib provided on the inner body and forming a line of contact with the outer body.

However, although they allow controlling the torque between the inner body and outer body, the lips proposed by the prior art have several disadvantages.

In particular, the lips proposed by the prior art extend along the perimeter of the inner body, and as a result provide a contact surface between the inner body and outer body that is limited by the size of the perimeter of the inner body. The minimum torque is therefore also limited.

In addition, the dimensions of the lips of cases from the same manufacturing line are not necessarily stable. For example, in the case where the inner body and the lip are obtained by molding, dimensional variation between two inner bodies is inevitable even if they are from the same mold. However, the transverse dimension of the lip must be sufficient to be able to absorb dimensional differences, but must also ensure the desired torque between the inner body and outer body. Thus, for example, the greater the transverse dimension of the lip, the better the absorption of dimensional differences but the greater the rotational torque required between the inner body and outer body. This causes differences in rotational torque between cases originating from the same manufacturing process, and therefore differences in performance that may be perceived by the user as differences in quality.

The invention aims to propose a solution to the above-mentioned problems of the prior art concerning lipstick cases.

More particularly, the invention proposes a lip that allows imposing torque between the inner body and the casing, and that has a novel form easily adaptable to the use required, without significantly increasing manufacturing costs.

SUMMARY OF THE INVENTION

According to a first aspect, the invention relates to a case for a stick of material to be applied by friction, in particular a stick of lipstick, comprising:

- a hollow cylindrical inner body, having a main axis, open at a proximal end, capable of receiving the stick of material;
- a hollow cylindrical outer body, having a main axis, open at a proximal end, into which the inner body is fitted so as to pivot relative to the outer body about the main axis, a cylindrical outer surface of the inner body facing a cylindrical inner surface of the inner body;
- elements for blocking axial movement between the inner body and the outer body,
- elements for controlling the rotation about the main axis of the inner body within the outer body.

The case further comprises at least one flexible lip, projecting radially with respect to the main axis on one among the outer surface of the inner body and the inner surface of the outer body, and extending at least partially around the main axis, the other among the inner surface of the outer body and the outer surface of the inner body being in contact with a braking portion of the lip, referred to as the braking portion, so as to control the torque of rotating the inner body within the outer body about the main axis.

The braking portion of the lip then comprises at least one inclined section extending in a main extension direction, said main extension direction comprising at least one component parallel to the main axis, so that during manipulation of the elements for controlling the rotation of the inner body within the outer body about the main axis, the inclined section of the braking portion is biased to bend in the direction of rotation of the outer body relative to the inner body about the main axis.

The inclined section then has what we will refer to as an "oblique" contact with the outer surface of the inner body or with the inner surface of the outer body, applying a braking torque that has little or no dependency on dimensional variations that may occur between two cases originating from a same manufacturing process.

In addition, the case may present the following features, alone or in combination:

- the braking portion of the lip comprises at least one inclined section for which the main extension direction is parallel to the main axis;
- the braking portion of the lip comprises at least one inclined section for which the main extension direction is transverse to the main axis;
- the lip comprises at least two inclined sections for which the main extension directions are parallel;
- the lip comprises at least two adjacent successive inclined sections, their respective main extension directions being secant;
- the lip comprises a plurality of inclined sections successively connected so as to form corrugations;
- the lip comprises a plurality of inclined sections successively connected so as to form notches;
- the lip comprises a plurality of inclined sections successively connected so as to form zigzags;
- the lip comprises a plurality of inclined sections alternating with straight sections, each straight section extending only angularly around the main axis.

According to one embodiment, the braking portion of the lip extends discontinuously around the main axis. The braking portion is then, for example, formed only on the at least one inclined section, the rest of the lip being at a distance from the other among the inner surface of the outer body and the outer surface of the inner body.

According to another embodiment, the braking portion of the lip extends continuously around the main axis, the lip being in contact along all of the other among the inner surface of the outer body and the outer surface of the inner body.

The elements for guiding the stick in translation along the main axis may, for example, comprise a cup suitable for receiving the stick of product. The cup has a sliding connection along the main axis with one among the inner body and outer body, and has a helical connection along the main axis with the other among the inner body and outer body, so as to alternately extend the stick out of the case through the opening and retract it into the case by rotation of the outer body relative to the inner body.

According to one embodiment, the case may further comprise a covering sleeve into which the outer body is inserted and comprising elements for blocking rotational and translational movement of the outer body within the covering sleeve.

According to this embodiment, the elements for blocking movement of the outer body within the covering sleeve comprise, for example, axial ribs formed on the outer surface of the outer body and axial ribs formed on an inner surface of the covering sleeve. The axial ribs of the outer body engage with the ribs of the covering sleeve to prevent rotation of the inner body relative to the outer body.

The elements for blocking movement of the outer body within the covering sleeve may comprise a first abutment between the outer body and the covering sleeve, preventing movement in a first direction along the main axis, and a second abutment between the outer body and the covering sleeve, preventing movement in the second direction along the main axis.

The outer body is, for example, snap-fitted onto the inner body between two abutments serving to prevent movement in the two opposite directions along the main axis.

According to a second aspect, the invention also provides a hollow cylindrical body comprising a lip, said body being specifically intended to be an inner body of a case as presented above.

According to a third aspect, the invention also provides a packaged product, in particular a cosmetic product, comprising a stick of material to be applied by friction, the stick being contained in a case as presented above.

BRIEF DESCRIPTION OF THE DRAWINGS

The drawings in the figures are now briefly described.

FIG. 4 is a three-dimensional view of a cross-section of the outer body of FIG. 2 assembled with the covering sleeve of FIG. 3.

FIG. 5 is a detail view of a longitudinal section of the outer body of FIG. 2 assembled with the covering sleeve of FIG. 3.

DETAILED DESCRIPTION

Below is a detailed description of several embodiments of the invention, with examples and with reference to the drawings.

Figure 1:
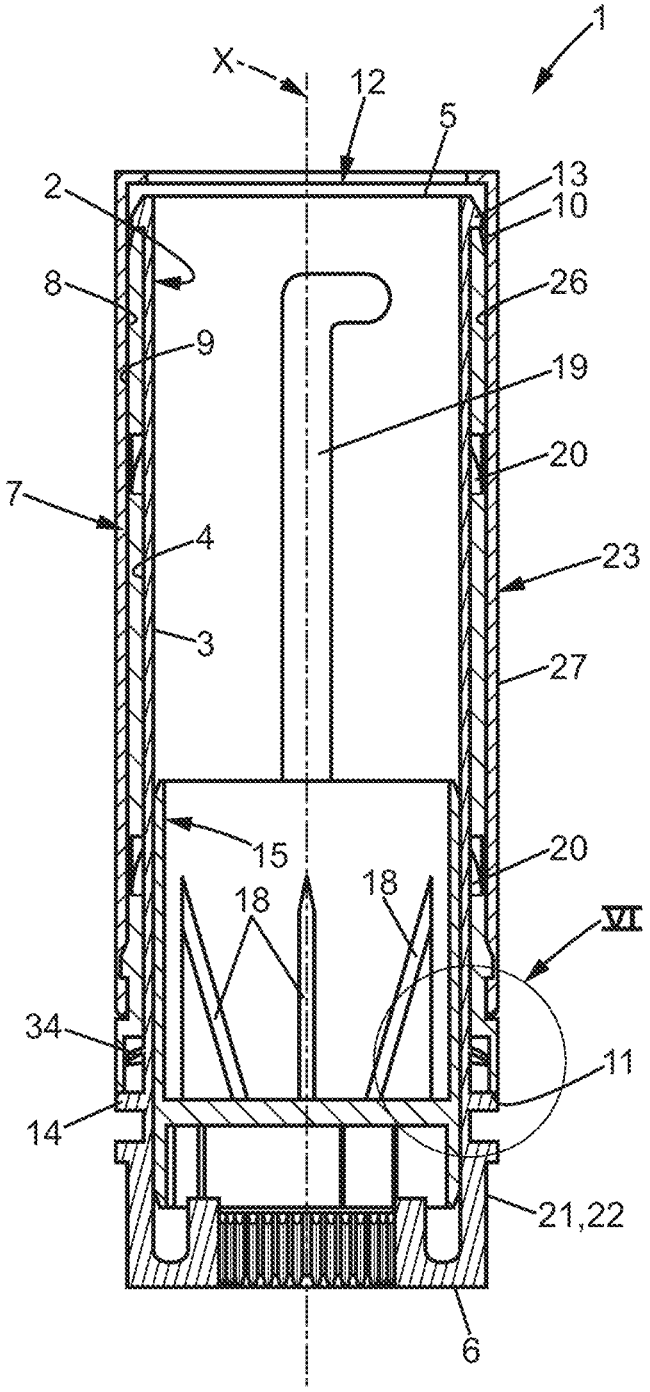
FIG. 1 is a diagram corresponding to a longitudinal section of a lipstick case.
Figure 2:
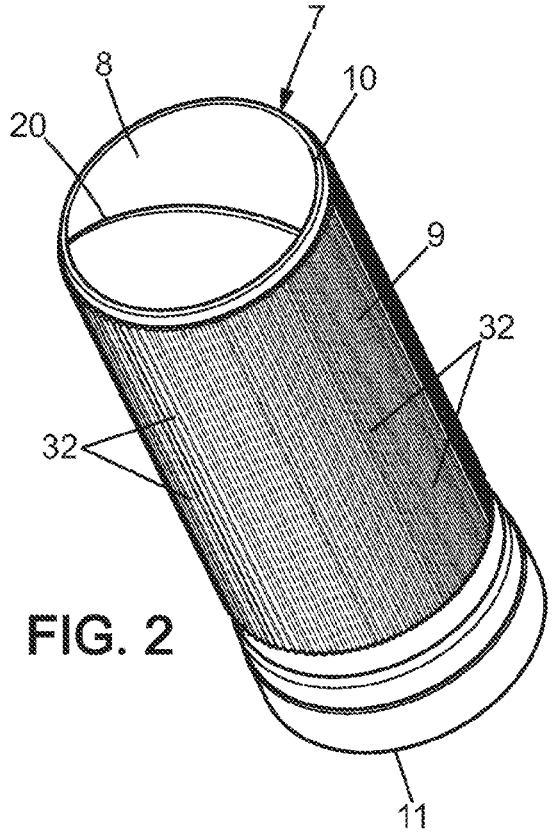
FIG. 2 is a perspective view of an outer body of the case of FIG. 1.
Figure 3:
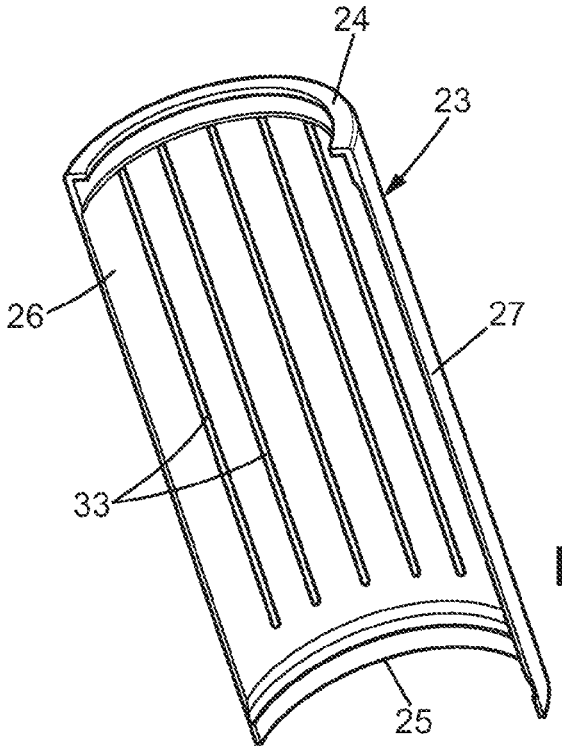
FIG. 3 is a three-dimensional partial section view of a covering sleeve of the case of FIG. 1.
Figure 6:
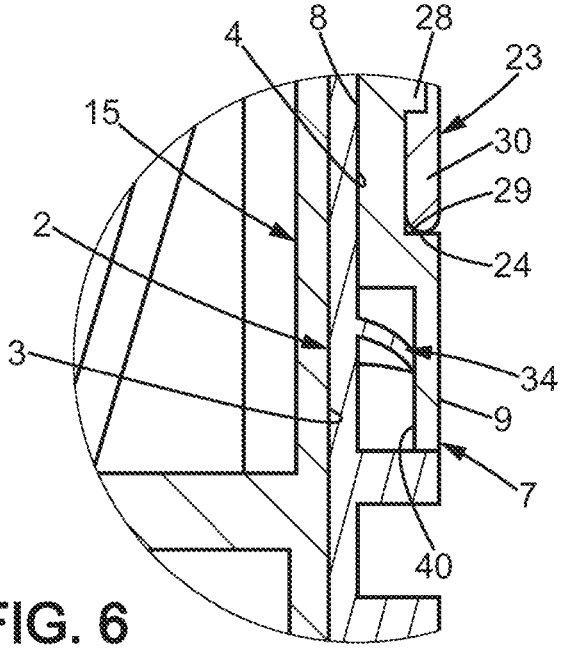
FIG. 6 is a detail view of the case of FIG. 1.
Figure 7:
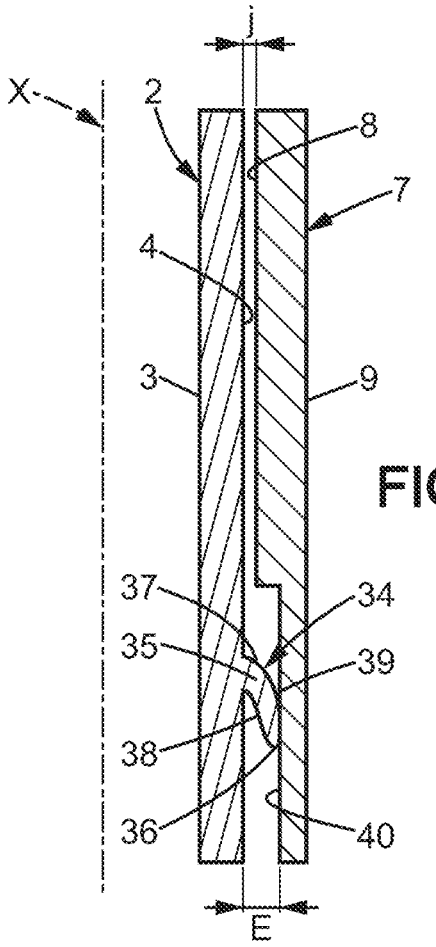
FIG. 7 is a schematic representation of a longitudinal section of an inner body of the case of FIG. 1 and of the outer body of FIG. 2.
Figure 10:
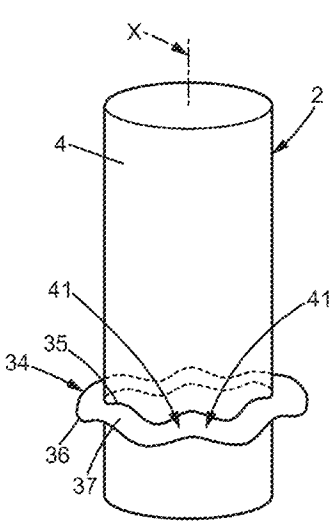
FIGS. 8 to 12 are schematic representations of the inner body of the case of FIG. 1 according to five different embodiments.
Figure 9:
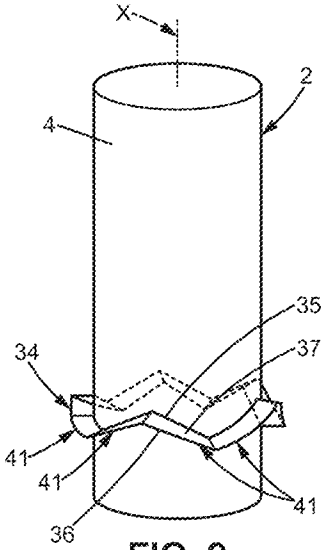
Figure 8:
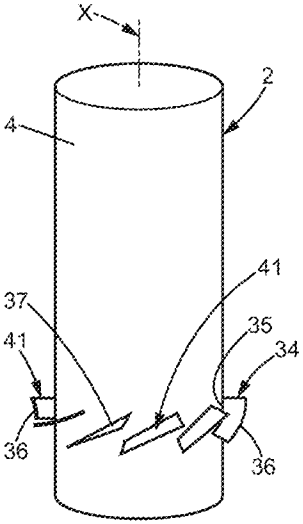
Figure 12:
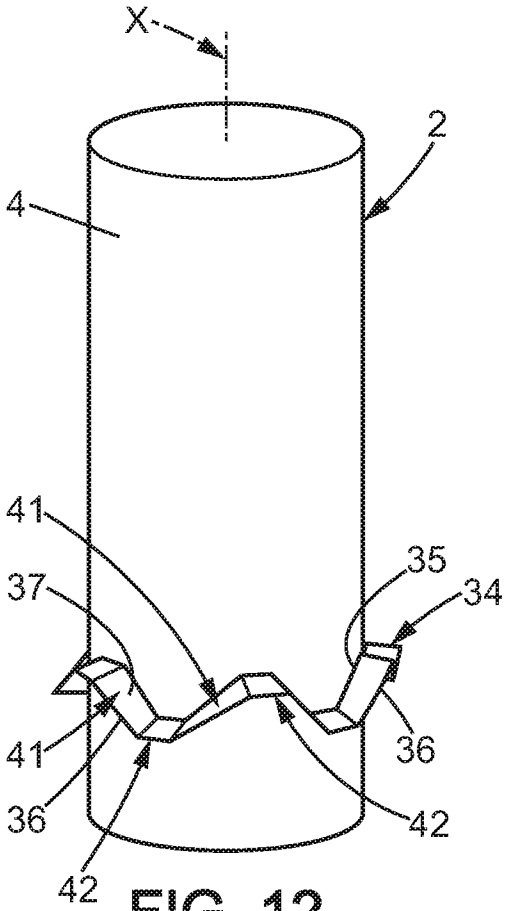

In FIG. 1, a case 1 for a stick of cosmetic material to be applied by friction, in particular a stick of lipstick, is represented.

The case 1 comprises a tubular hollow inner body 2, having an inner surface 3 and an outer surface 4. The inner body 2 extends along a main axis X between a proximal end 5 and a distal end 6, and is open at the proximal end 5. The inner surface 3 of the inner body 2 is, for example, of substantially circular cross-section. The outer surface 4 of the inner body 2 is also of substantially circular cross-section.

In the following, "axial", "axially", etc. refer to any direction parallel to the main axis X, and "transverse", "transversely", etc. refer to any direction perpendicular to the main axis X.

The case 1 further comprises a tubular hollow outer body 7, fitted onto the inner body 2. The outer body 7 also has an inner surface 8 and an outer surface 9. The inner surface 8 of the outer body 7 is of substantially circular cross-section, and its transverse dimensions substantially correspond to the transverse dimensions of the outer surface 4 of the inner body 2, such that the outer body 7 can be fitted onto the inner body 2 with minimal play that is just sufficient to allow relative rotation between the outer body 7 and inner body 2 about the main axis X. The hollow outer body 7 extends along the main axis X between a proximal end 10 and a distal end 11, which are both open. Thus, the outer body 7 can be fitted onto the inner body 2 so that their open proximal ends 5, 10 coincide, defining an opening 12 of the case 1.

elements for blocking axial translation between the inner body 2 and the outer body 7 are provided. For example, the inner body 2 comprises two flanges 13, 14, projecting transversely from its outer surface 4, spaced apart from one another by an axial dimension substantially corresponding to the axial dimension of the outer body 7. A first flange 13 is positioned near the proximal end 5 of the inner body 2, and forms an axial abutment preventing axial movement in a first direction for the proximal end 10 of the inner body 7. The second flange 14 is at a distance from the first flange 13, toward the distal end 6 of the inner body 2, and forms an axial abutment preventing axial movement in the second direction for the distal end 11 of the outer body 7. Thus, the outer body 7 between the two flanges 13, 14 is prevented from axial movement but is free to rotate about the main axis X relative to the inner body 2.

A cup 15 is mounted within the inner body 2 and forms a housing for the stick of material. The cup 15 comprises a side wall 16 rising around the main axis X from a transverse base 17, toward the opening 12 of the case 1. The stick is held in the cup 15 by friction with the side wall 16. The cup 15 may possibly include fins 18 extending into the stick housing, intended to bite into the stick of material in order to grip it. The stick is thus held in the cup 15, preventing translational and rotational movement.

The cup 15 is in a helical connection with the assembly formed by the inner body 2 and outer body 7. For this purpose, for example, the inner body 2 comprises at least one axial groove 19 which pierces said inner body. In practice, the inner body 2 comprises two axial grooves, symmetrical with one another relative to the main axis X. The outer body 7 comprises at least one helical groove 20 spiraling around the main axis X. In practice, the outer body 7 comprises two helical grooves, symmetrical with one another relative to the main axis X. The helical grooves 20 may not pierce the outer body 7. The cup 15 then comprises at least one pin, and in practice two pins. Each pin is inserted into an axial groove 19 and, projecting through the inner body 2, into a helical groove 20.

The case further comprises means 21 for controlling the rotation of the outer body 7 relative to the inner body 2 about the main axis X. For this purpose, for example, the axial dimension of the outer body 7 is smaller than that of the inner body 2. The distal end 6 of the inner body 2 can then protrude beyond the distal end 11 of the outer body 7. Thus, the inner body 2 comprises what is referred to as a manipulation portion 22, which is not covered by the outer body 7 and which is accessible to a user.

The user can thus cause translational movement of the cup 15 by rotating the outer body 7 relative to the inner body 2 about the main axis X, by means of the manipulation portion 22. The rotational movement is converted into an axial translational movement of the cup 15, between a retracted position where the stick is completely inside the case 1 and a position where the stick at least partially protrudes from the case through the opening 12.

The case 1 may further comprise a covering sleeve 23 that covers the outer body 7 along its entire axial dimension. More specifically, the sleeve 23 extends along the main axis X between a proximal end 24 and a distal end 25. The covering sleeve 23 has an inner surface 26, and an outer surface 27. The proximal end 24 curves in so that it covers the proximal end 5 of the inner body 2. The proximal end 24 of the covering sleeve 23 is thus in axial abutment in a first direction along the axis on the proximal end 5 of the inner body 2. The axial abutment in the second direction along the axis is provided on the outer body 7. For this purpose, the outer surface 9 of the inner body 7 comprises a transversely projecting hook 28. The outer surface 9 of the body 7 also comprises, axially distanced from the hook 28, towards the distal end 11, a shoulder 29 which together with the hook 28 defines a housing for locking a tab 30 formed on the inner surface 26 of the covering sleeve 23, between the distal end 24 of the sleeve 23 and a recess 31 on the inner surface 26 of the sleeve 23. Thus, the tab 30 is in axial abutment against the shoulder 29 in the first direction and against the hook 28 in the second direction, the hook 28 of the outer body 7 inserting in a substantially complementary manner into the recess 31 of the sleeve 23.

Means are also provided for blocking rotation between the covering sleeve 23 and outer body 7. For example, the outer body 7 comprises a plurality of ribs 32 extending axially over at least a portion of its outer surface 9. The sleeve 23 comprises a plurality of complementary ribs 33 projecting from its inner surface 26, for engaging with the ribs 32 of the outer body 7. The ribs 33 of the sleeve 23 thus lodge between two successive adjacent ribs 32 of the outer body 7.

In this manner, the sleeve 23 is prevented from both axial movement and rotation about the main axis X relative to the outer body 7, without requiring additional means such as glue or welding.

The outer surface 27 of the sleeve 23 serves to provide aesthetic elements for the case 1. In effect, the outer surface 27 of the sleeve 23 may be smooth, or may present various colors or patterns or decorative elements.

The case 1 may further comprise a removable cap, fitting over the sleeve 23 to close off the opening 12 of the case 1.

In order to control the torque of the outer body 7 relative to the inner body 2 about the main axis X, the case 1 further comprises a flexible lip 34.

"Flexible" is understood here to mean the ability of the lip 34 to deform elastically, without breaking, when a defined stress is applied.

According to one embodiment, the lip 34 projects radially from the outer surface 4 of the inner body 2 and extends angularly to the main axis X. The lip 34 comprises an edge 35 rigidly attached to the inner body 2, a free radial end edge 36, a proximal face 37 oriented toward the proximal ends 5, 10 of the inner body 2 and outer body 7, and a distal face 38 oriented toward the distal ends 6, 11 of the inner body 2 and outer body 7. For example, the lip 34 is an integral part of the inner body 2, or is overmolded onto the inner body 2. Alternatively, the lip 34 may be a radial projection on the inner surface 8 of the outer body 7.

In the following, the transverse direction is defined as comprising a radial direction and an angular direction in reference to surfaces 3, 4, 8, and 9 of the inner body 2 and outer body 7, as an analogy with cylindrical coordinates, for a system in which the main axis X can be considered to be the height axis. Therefore, in the following, expressions such as "radial", "radially", etc. refer to the radial direction of one among the inner body 2 and outer body 7 in cylindrical coordinates; expressions such as "angular", "angularly", etc. refer to the angular direction of the other among the inner body 2 and outer body 7 in cylindrical coordinates.

The lip 34 has, for at least one sector around the main axis X, a radial end portion 39, called the braking portion 39, in contact with the outer body 7. Thus, the braking portion 39 is defined as the portion of the lip coming into contact with the outer body 7 when the inner body 2 is fitted into the outer body 7.

More specifically, the inner surface 8 of the outer body 7 comprises a widening of its cross-section, for example towards the distal end 11 of the outer body 7, forming a braking surface 40 whose transverse dimension is greater than the transverse dimension of the rest of the inner surface 8. The rotation about the main axis X of the outer body 7 relative to the inner body 2 is guided by the sliding of a portion of the inner surface 8 of the outer body 7 on the outer surface 4 of the inner body 2, between which a minimal clearance j is formed, while a radial gap, denoted E, greater than the clearance, is formed between the outer surface 4 of the inner body 2 and the braking surface 40 of the outer body 7. Before assembly of the outer body 7 onto the inner body 2, the radial dimension of the lip 34 over at least an angular sector about the main axis X is greater than the gap E.

Thus, when the outer body 7 is fitted onto the inner body 2, the braking surface 40 deforms the flexible lip 34 and causes it to bend to form the braking portion 39 in contact with the braking surface 40. As the lip 34 wants to return to its initial shape, the braking portion 39 exerts force at a point of the braking surface 40 of which at least one component is parallel to the axial direction, the other component being radial.

"Component" is understood here to mean the vector definition. Thus, the component of the braking force parallel to the axial direction refers to breaking down the braking force into vectors in the axial, radial, and angular directions, in accordance with a cylindrical coordinate system, at a point of the braking surface 40.

The lip 34 thus controls the torque. Indeed, the greater the radial dimension of the lip 34 prior to assembly of the inner body 2 and outer body 7, the more extensive the braking portion 39, and the greater the contact area between the braking portion 39 and the braking surface 40. The force exerted by the lip 34 on the outer body 7, which is proportional to the contact area, is then all the greater. The lip 34 rubs against the braking surface 40 and acts to brake the rotation between the inner body 2 and outer body 7, imposing a minimum torque that the user must apply between the inner body 2 and outer body 7 to cause their relative rotation, called the braking torque.

However, as discussed in the Introduction, two cases 1 manufactured by the same process may have dimensional deviations, in particular in their lip 34, resulting in differences in braking torque between the inner body 2 and the outer body 7.

An example illustrating the dimensional variation phenomenon will now be given.

In this example, we consider a lipstick case comprising an inner body 2 and an outer body 7, a lip 34 projecting radially from the outer surface 4 of the inner body 2. The radial dimension of the lip 34 prior to assembly of the inner body 2 within the outer body 7 is denoted D, and is fixed at a nominal value, for example 17 mm (millimeters). The radial dimension of the outer body 7 to its inner surface 8 is denoted d and is fixed at a nominal value of 16.8 mm. The expected dimensional variation for these two dimensions D and d in a manufacturing process is +/−0.1 mm.

Thus, two extreme cases may occur.

In a first case, called maximum grip, the dimension D of the lip 34 is 17+0.1 mm, or 17.1 mm, and the dimension d of the inner surface 8 of the outer body 7 is 16.8−0.1 mm, or 16.7 mm. Thus, the lip 34 will come into contact with the inner surface 8 of the outer body 7 over a radial dimension of about 0.4 mm (corresponding to D-d). The contact area will therefore be large, with maximal braking torque.

In a second case, called minimum grip, the dimension D of the lip 34 is 17−0.1 mm, or 16.9 mm, and the dimension d of the inner surface 8 of the outer body 7 is 16.8+0.1 mm. or 16.9 mm. Thus, the lip 34 will come into contact with the inner surface 8 of the outer body 7 over a radial dimension of about 0 mm (corresponding to D-d). More specifically, only the free edge 36 of the lip 34 is in contact with the inner surface 8 of the outer body 7. Thus, the braking torque is minimal or nonexistent.

If, in the case of minimum grip, we still wish to ensure that the lip 34 comes in contact with the inner surface 8 of the outer body 7 over a dimension of 0.1 mm, then in the case of maximum grip, the lip 34 is in contact with the inner surface 8 of the outer body 7 over a radial dimension of 0.5 mm, further increasing the maximum braking torque, such that the range of values that the braking torque can vary from one case to another because of dimensional variations is not actually reduced.

It is therefore understood that dimensional variations cause a variation of the braking torque within a range of values which can be significant, and which in any case are sufficient to be felt by the user.

To remedy this, the braking portion 39 of the lip 34 comprises at least one inclined section 41 extending in a main extension direction of which at least one component is parallel to the main axis X. The adjective "inclined" is used here in relation to the angular direction. The main extension direction indicates the direction in which the inclined section 41 has the largest dimension. In other words, the adjective "inclined" is to be interpreted in a plane parallel to the axial direction and to the angular direction, the main extension direction being inclined relative to the angular direction. Thus, the inclined section 41 extends in a main direction comprising for example a component extending in the angular direction and a component extending in the axial direction, providing over the inner surface 8 of the outer body 7 a contact which can be said to be oblique (in reference to the angular direction). Alternatively, the inclined section 41 may extend in a direction in which the only component is axial. In other words, the inclined section 41 is not parallel to the angular direction. The inclined section 41 is not necessarily rectilinear, in other words extending in a fixed direction, but may be curved. In this case, the extension direction of the inclined section 41 is defined at each point of the inclined section 41 as the tangent at this point, a tangent which comprises at least an axial component.

As before, the noun "component" is used here in reference to the vector definition. Thus, in a cylindrical coordinate system, the main extension direction of the inclined section 41 comprises at least an axial component.

In practice, the braking portion 3 of the lip 34 comprises a plurality of inclined sections 41. The braking portion 39 may also include, in addition to the inclined sections 41, what we will call straight sections 42 in which the main extension direction is parallel to the angular direction about the main axis X.

Thus, when the inner body 2 is fitted into the outer body 7, each inclined section 41 is bent around an axis of flexure of which at least one component is axial. The axis of flexure substantially coincides with the main extension direction of the corresponding inclined section 41. Each axis of flexure is specific to an inclined section 41. The straight sections 42 are bent around an angular direction.

Thus, when the outer body 7 pivots in a first direction about the main axis X relative to the inner body 2, each inclined section 41 is bent around its axis of flexure in a first flexure direction which follows the direction of rotation between the inner body 2 and the outer body 7. Similarly, when the outer body 7 pivots in the second direction about the main axis X relative to the inner body 2, each inclined section 41 is bent about its axis of flexure in the second flexure direction which follows the direction of rotation between the inner body 2 and the outer body 7.

More specifically, let us consider the example in which the direction of inclination of the inclined section 41 follows the direction of inclination of the helical groove 20, in other words the main extension direction of the inclined section 41 comprises an angular component and is oriented in the direction of rotation of the helical groove 20 from the distal end 6, 11 of one and/or the other among the inner body 2 and outer body 7 toward the proximal distal end 5, 10 of one and/or the other among the inner body 2 and outer body 7. Consider also that in this example, after assembly of the inner body 2 within the outer body 7, the lip 34 is forced to bend so that the inclined section 41 is in contact with the braking surface 40 by the proximal face 37 of the lip 34. The user can rotate the outer body 7 on the inner body 2 about the main axis X in a first direction to cause the stick to protrude from the case 1. The direction of rotation of the outer body 7 on the inner body 2 then corresponds to the direction of rotation of the helical groove 20 and the direction of inclination of the inclined section 41, so that the braking surface 40 slides over the proximal face 37 of the lip 34. When the user rotates the outer body 7 on the inner body 2 in the opposite direction in order to return the stick into the case 1, the friction of the braking surface 40 causes the section 41 to bend in this other direction, about its axis of flexure. The braking section 41 is thus turned over by the friction, so that the braking surface 40 slides over the distal face 38 of the lip 34.

In other words, the bent inclined section 41 follows the direction of rotation between the inner body 2 and the outer body 7. Conversely, any straight section 42 remains bent in a same direction, without turning over, regardless of the direction of rotation between the inner body 2 and outer body 7.

The result is the same in the case where the inclined section 41 is in contact with the braking surface 40 by the radial end edge 36.

This results in a more stable torque for different cases 1 originating from the same manufacturing process and having dimensional variations between them.

In effect, the bending of the inclined sections 41 follows the direction of rotation between the inner body 2 and the outer body 7, so that they form a ramp for the outer body 7. The outer body 7 slides on the inclined sections 41, which lie flat around their axis of bending. As the flexible lip 34 wants to return to its initial shape from before the assembly of the inner body 2 within the outer body 7, the inclined sections 41 of the braking portion 39 exert force on a point of the braking surface 40, of which at least one component is parallel to the angular direction, the other component being radial. However, the rotation between the inner body 2 and outer body 7 about the main axis X tends to exert force on the inclined sections 41 of the braking portion 39 in the opposite direction, along the angular direction, to that of the force exerted by the lip, keeping the inclined sections 41 flattened. Thus, when the lip 34 has a radial dimension on the inclined sections 41, prior to assembly of the inner body 2 within the outer body 7, the lip 34 may comprise a portion extending beyond the braking portion 39 to the free edge 36, which does not contribute to the exertion of force on the braking surface 40 as it is kept away from the braking surface 40 by the rotational movement. This portion beyond the braking portion 39 therefore does not contribute to controlling the braking torque.

There then exists a maximum radial dimension of the lip 34, before assembly, where the braking torque varies little if at all. This maximum radial dimension is less than that of the lips of the prior art, which do not include inclined sections on the braking portion, the lips of the prior art not being laid flat by the rotation between the inner body 2 and outer body 7.

In other words, due to the inclined sections 41, in spite of dimensional differences between the lips 34 of different cases 1, the braking torque for multiple cases 1 remains with a smaller range of values than for cases of the prior art without inclined sections.

The braking torque can still be adapted by adjusting the total axial dimension of the braking portion 39 of the lip 34 on the inclined sections 41, for example by adjusting the number of inclined sections 41 and/or the dimension of axial extension of each inclined section 41. This axial dimension of the extension of the braking portion 39 has little or no dependency on radial dimensional variations of the lip 34.

Several alternative embodiments of the lip 34 are possible.

In particular, the braking portion 39 may comprise only a succession of inclined sections 41, which may be unconnected to one another or may be successively connected to form different patterns such as zigzags, corrugations, or notches. The absence of straight portions 40 serves in particular to render the braking torque substantially independent of dimensional variations.

Alternatively, the braking portion 39 may comprise inclined sections 41 alternating with straight sections 40.

The inclined sections 41 may have parallel or secant main extension directions. When the main extension directions of the inclined sections 41 are secant or parallel to the axial direction, then the braking torque implemented by the inclined sections 41 has little or no dependency on the direction of rotation about the main axis X between the inner body 2 and the outer body 7. On the contrary, the braking torque can be increased in one rotational direction relative to the other by adjusting the inclination in one direction or the other of the main extension directions of the inclined sections 41.

Finally, the braking portion 39 may extend continuously over the entire radial end of the lip 34, meaning that continuous contact is formed between the lip 34 and the contact surface 38 all around the main axis X. However, the braking portion 39 may be discontinuous and extend only over an angular portion or several angular portions of the lip 34, the lip 34 then comprising angular portions where the lip 34, and more precisely its free edge 36, remains apart from the contact surface 38.

A few example embodiments of the braking portion 39 will now be described in more detail, with reference to schematic FIGS. 8 to 12, for the case where the braking portion 39 extends continuously over the entire lip 34 about the main axis X. For purposes of illustration, only the inner body 2 providing the lip 34 is represented, the outer body 7 being absent.

According to a first example (FIG. 8), the lip 34 is such that the braking portion 39 comprises only rectilinear inclined sections 41, and is discontinuous along the outer surface 4 of the inner body 2. Thus, the braking portion 39 has no straight portions 40, the latter making the braking torque more sensitive to dimensional variations. For example, the inclined sections 41 have a main extension direction containing a single component which is axial. The torque is then constant regardless of the direction of rotation between the inner body 2 and the outer body 7. According to another example, the inclined sections 41 extend parallel to each other, in other words their main extension direction is parallel. According to yet another exemplary embodiment, pairs of inclined sections 41 form an angle. More specifically, in this other example, the main extension direction of a first inclined section 41 is secant with the main extension direction of the adjacent successive inclined section 41. The lip 34 then forms, for example, a plurality of fins on the outer surface 4 of the inner body 2.

In a second example (FIG. 9), the lip 34 is such that the braking portion 39 only comprises rectilinear inclined sections 41, which are connected so as to be continuous and pairs of which form an angle. The lip 34 thus forms zigzags on the outer surface 4 of the inner body 2.

Figure 11:
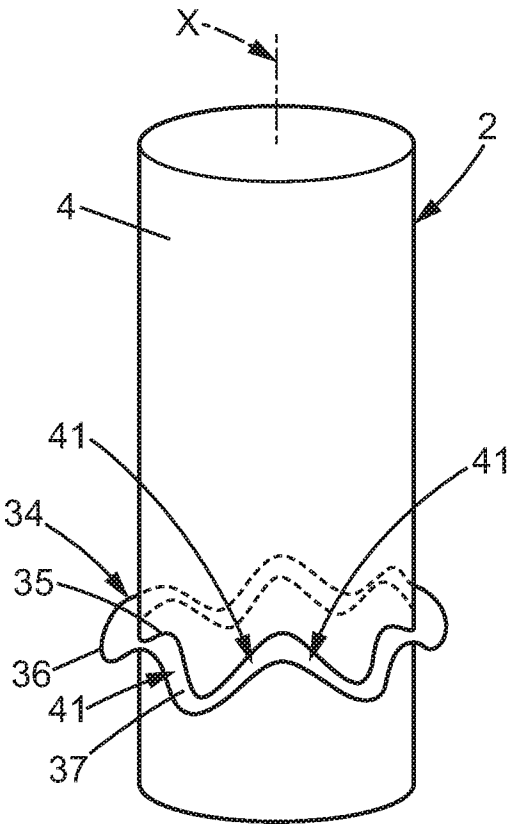

According to a third example, the lip 34 is such that the braking portion 39 also comprises only inclined sections 41 but these are at least partially curved, two adjacent successive inclined sections 41 meeting at a point where the tangent is parallel to the angular direction. As a result, the lip 34 forms waves on the outer surface 4 of the inner body 2. The waves may be regular (FIG. 10), in other words regularly repeating a same pattern, or irregular (FIG. 11).

According to a fourth example (FIG. 12), the lip 34 is such that the braking portion 39 of the lip comprises rectilinear inclined sections 41, alternating with straight portions 40. The inclined sections 41 may or may not have their main extension direction be parallel to the axial direction; and more specifically pairs of the inclined sections 41 may have their main extension directions form an angle. The lip 34 then forms a notched pattern on the outer surface 4 of the inner body 2.

The braking portion 39 may be formed of a combination of these examples.

In the examples presented, the shape of the lip 34 substantially follows the shape of the braking portion 39, in other words the edge 35 rigidly fixed to the inner body 2 has substantially the same shape as the free edge 36. However, it may be provided for example that the edge 35 rigidly fixed to the inner body 2 is circular on the outer surface 4 of the inner body 2, and the free edge 36 has a finned, zigzagging, wavy, and/or notched shape, giving the braking section 39 the corresponding shape.

A lip 35 formed in this manner provides better control of the braking torque between the outer body 2 and inner body 7, so as to obtain a substantially identical braking torque between different cases 1 originating from the same manufacturing process. The inclined sections 41 of the lip 34 may have different arrangements, allowing a substantially constant torque for a case 1 regardless of the direction of rotation between the outer body 2 and inner body 7 about the main axis X.

The invention claimed is:

1. Case for a stick of material to be applied by friction, in particular a stick of lipstick, wherein the case comprises:

a hollow cylindrical inner body, having a main axis in an axial direction, open at a proximal end, capable of receiving the stick of material, the inner body having a radial direction perpendicular to the axial direction, an angular direction being perpendicular to the axial direction and the radial direction;

a hollow cylindrical outer body, having a main axis, open at a proximal end, into which the inner body is fitted so as to pivot relative to the outer body about the main axis, a cylindrical outer surface of the inner body facing a cylindrical inner surface of the inner body;

elements for blocking axial movement between the inner body and the outer body;

elements for controlling the rotation about the main axis of the inner body within the outer body; and at least one flexible lip, projecting radially with respect to the main axis on one among the outer surface of the inner body and the inner surface of the outer body, and extending at least partially around the main axis, the other among the inner surface of the outer body and the outer surface of the inner body being in contact with a braking portion of the lip, called the braking portion, so as to control the torque of rotating the inner body within the outer body about the main axis, wherein the braking portion of the lip comprises at least one inclined section extending in a main extension direction, the main extension direction being in in a plane containing the axial direction and the angular direction, the main extension direction being at a non-zero angle relative to an angular direction, during manipulation of the elements for controlling the rotation of the inner body within the outer body about the main axis, the inclined section of the braking portion is biased to bend in the direction of rotation of the outer body relative to the inner body about the main axis.

2. Case according to claim 1, wherein the braking portion of the lip comprises at least one inclined section for which the main extension direction is parallel to the main axis.

3. Case according to claim 1, wherein the braking portion of the lip comprises at least one inclined section for which the main extension direction is transverse to the main axis.

4. Case according to claim 1, wherein the lip comprises at least two inclined sections for which the main extension directions are parallel.

5. Case according to claim 1, wherein the lip comprises at least two adjacent successive inclined sections, their respective main extension directions being secant.

6. Case according to claim 1, wherein the lip comprises a plurality of inclined sections successively connected so as to form corrugations.

7. Case according to claim 1, wherein the lip comprises a plurality of inclined sections successively connected so as to form notches.

8. Case according to claim 1, wherein the lip comprises a plurality of inclined sections successively connected so as to form zigzags.

9. Case according to claim 1, wherein the lip comprises a plurality of inclined sections alternating with straight sections, each straight section extending only angularly around the main axis.

10. Case according to claim 1, wherein the braking portion of the lip extends discontinuously around the main axis.

11. Case according to claim 10, wherein the braking portion is formed only on the at least one inclined section, the rest of the lip being at a distance from the other among the inner surface of the outer body and the outer surface of the inner body.

12. Case according to claim 1, wherein the braking portion of the lip extends continuously around the main axis, the lip being in contact along all of the other among the inner surface of the outer body and outer surface of the inner body.

13. Case according to claim 1, wherein the elements for guiding the stick in translation along the main axis comprises a cup suitable for receiving the stick of product, the cup having a sliding connection along the main axis with one among the inner body and outer body and having a helical connection along the main axis with the other among the inner body and outer body, so as to alternately extend the stick out of the case through the opening and retract it into the case by rotation of the outer body relative to the inner body.

14. Case according to claim 1, comprising a covering sleeve into which the outer body is inserted and comprising elements for blocking rotational and translational movement of the outer body within the covering sleeve.

15. Case according to claim 14, wherein the elements for blocking movement of the outer body within the covering sleeve comprise axial ribs formed on the outer surface of the outer body and axial ribs formed on an inner surface of the covering sleeve, the axial ribs of the outer body engaging with the ribs of the covering sleeve to prevent rotation of the inner body relative to the outer body.

16. Case according to claim 14, wherein the means of blocking movement of the outer body within the covering sleeve comprise a first abutment between the outer body and the covering sleeve, preventing movement in a first direction along the main axis, and a second abutment between the outer body and the covering sleeve, preventing movement in the second direction along the main axis.

17. Case according to claim 1, wherein the outer body is snap-fitted onto the inner body between two abutments serving to prevent movement in the two opposite directions along the main axis.

18. Hollow cylindrical body comprising a lip, the body being specifically intended to be an inner body of a case, the hollow cylindrical inner body having a main axis in an axial direction, open at a proximal end, capable of receiving the stick of material, the inner body having a radial direction, an angular direction being perpendicular to the axial direction and the radial direction, the case further including:

a hollow cylindrical outer body, having a main axis, open at a proximal end, into which the inner body is fitted so as to pivot relative to the outer body about the main axis, a cylindrical outer surface of the inner body facing a cylindrical inner surface of the inner body;

elements for blocking axial movement between the inner body and the outer body;

elements for controlling the rotation about the main axis of the inner body within the outer body; and at least one flexible lip, projecting radially with respect to the main axis on one among the outer surface of the inner body and the inner surface of the outer body, and extending at least partially around the main axis, the other among the inner surface of the outer body and the outer surface of the inner body being in contact with a braking portion of the lip, called the braking portion, so as to control the torque of rotating the inner body within the outer body about the main axis, wherein the braking portion of the lip comprises at least one inclined section extending in a main extension direction, the main extension direction being in in a plane containing the axial direction and the angular direction, the main extension direction being at a non-zero angle relative to an angular direction, during manipulation of the elements for controlling the rotation of the inner body within the outer body about the main axis, the inclined section of the braking portion is biased to bend in the direction of rotation of the outer body relative to the inner body about the main axis.

19. Packaged product, in particular a cosmetic product, comprising a stick of material to be applied by friction, the stick being contained in a case comprising:

a hollow cylindrical inner body in an axial direction, having a main axis, open at a proximal end, capable of receiving the stick of material, the inner body having a radial direction, an angular direction being perpendicular to the axial direction and the radial direction;

a hollow cylindrical outer body, having a main axis, open at a proximal end, into which the inner body is fitted so as to pivot relative to the outer body about the main axis, a cylindrical outer surface of the inner body facing a cylindrical inner surface of the inner body;

elements for blocking axial movement between the inner body and the outer body;

elements for controlling the rotation about the main axis of the inner body within the outer body; and at least one flexible lip, projecting radially with respect to the main axis on one among the outer surface of the inner body and the inner surface of the outer body, and extending at least partially around the main axis, the other among the inner surface of the outer body and the outer surface of the inner body being in contact with a braking portion of the lip, called the braking portion, so as to control the torque of rotating the inner body within the outer body about the main axis, wherein the braking portion of the lip comprises at least one inclined section extending in a main extension direction, the main extension direction being in in a plane containing the axial direction and the angular direction, the main extension direction being at a non-zero angle relative to an angular direction, during manipulation of the elements for controlling the rotation of the inner body within the outer body about the main axis, the inclined section of the braking portion is biased to bend in the direction of rotation of the outer body relative to the inner body about the main axis.

* * * * *